United States Patent [19]

Wüster

[11] Patent Number: 4,732,285

[45] Date of Patent: Mar. 22, 1988

[54] COLLAPSIBLE STRUCTURE

[76] Inventor: Heinrich Wüster, Auwerk 18, A-6460 Imst/Tirol, Austria

[21] Appl. No.: 903,034

[22] Filed: Sep. 2, 1986

[30] Foreign Application Priority Data

Sep. 4, 1985 [AT] Austria ..... 2583/85

[51] Int. Cl.[4] ..... A47F 5/00

[52] U.S. Cl. ..... 211/197; 211/1.3; 135/33 C; 150/52 R

[58] Field of Search ..... 211/197, 196, 205, 1.3; 135/33 C, 34; 150/52 R; 312/297

[56] References Cited

U.S. PATENT DOCUMENTS

| | | | |
|---|---|---|---|
| 2,545,022 | 3/1951 | Crewdson | 135/33 C |
| 2,784,848 | 3/1957 | Senne | 211/196 |
| 3,051,320 | 8/1962 | Barnett | 211/196 |
| 3,477,453 | 11/1969 | D'Ulisse et al. | 135/34 X |
| 3,490,469 | 1/1970 | Dubinsky | 150/52 R X |
| 4,276,819 | 7/1981 | Goldman et al. | 135/34 X |
| 4,550,840 | 11/1985 | Van Deursen | 211/197 |

*Primary Examiner*—Robert W. Gibson, Jr.
*Attorney, Agent, or Firm*—Kurt Kelman

[57] ABSTRACT

A collapsible structure consisting of an umbrella-like clothes drier or of a garden umbrella comprises a central tube and a folding frame, which carries a clothesline or a covering. A flexible sheath is provided, which is adapted to be slipped over the folding frame when it is collapsed. The flexible sheath may be sacklike (closed at one end and open at the other) and in that case may be accommodated in the central tube when the same is open-topped, or in a storage container, which is open-topped and is parallel to and extends beside the central tube. Alternatively the sheath may be tubular (open at both ends) and accommodated in a storage container which concentrically surrounds the lower portion of the central tube. The sacklike sheath can be pulled out of the central tube or the juxtaposed storage container at its top end and over an upwardly convex, annular guiding hood and can then be slipped from above over the collapsed folding frame. The tubular sheath can be pulled out of the open top of the concentric storage container and can be slipped from below over the collapsed folding frame. A rope or a spring, which is secured in the juxtaposed storage container or to the central tube on the inside thereof, is secured to the sacklike sheath and can be used to retract the sheath into the central tube of the juxtaposed storage container.

18 Claims, 6 Drawing Figures

COLLAPSIBLE STRUCTURE

BACKGROUND OF THE INVENTION

1. Field of the Invention

This invention relates to a collapsible structure, such as an umbrellalike clothes drier having a central tubular post and a spiderlike folding frame, which is preferably adjustably mounted on said post and carries a clothesline and can be unfolded and collapsed, or a garden umbrella having a central tube and a spiderlike folding frame, which carries a covering and can be unfolded and collapsed.

2. Description of the Prior Art

Umbrellalike clothes driers are often left outdoors after use so that they can readily be re-used for a drying of clothes without a need for substantial preparatory work.

But in many places the air is so highly polluted that the clothesline provided on the clothes drier is soiled quickly so that the clothesline and the spider arms or spreaders which will be contacted by the clothes to be dried must be cleaned in a time-consuming operation before each use of the drier. The clothesline may also be used when the clothes drier is carried in a collapsed form into a cellar or another room for storage.

Garden umbrellas are also left outdoors, as a rule, and are unfolded or collapsed as required. In places where the air is highly polluted for certain times, the covering of the garden umbrella will highly be soiled so that serious problems will arise, e.g., in connection with parasols having a printed fabric covering. The covering must be cleaned in a complicated operation after a relatively short time and such cleaning will adversely affect the fabric covering or the print thereon so that the umbrella will no longer have an attractive appearance.

It is known that umbrellalike clothes driers and garden umbrellas can be provided with flexible tubular sheaths, which are slipped over the umbrellalike clothes drier or the umbrella when it has been collapsed. For use with an umbrellalike clothes drier, such sheath may have a length up to 2 meters and its handling is most inconvenient and in most cases the sheath can be slipped over the unhandy clothes drier only by two persons cooperating with one another. It is also known to protect garden umbrellas by means of caps, which can be slipped onto the umbrella from the outside and which when not in use are stored separately from the garden umbrella and are fitted on the umbrella by means of stiff, long rods, which are inserted into respective pockets of the cap. Such caps for large garden umbrellas are extremely unhandy and when the cap has been removed the cap as well as the rod may be lost or damaged.

SUMMARY OF THE INVENTION

It is an object of the invention to eliminate the disadvantages outlined hereinbefore and to provide a sheath which can easily be applied at any time and is not likely to be lost and which can quickly be slipped over the umbrellalike clothes drier or the garden umbrella when it is collapsed and which can be removed just as quickly and can be made at extremely low cost.

In a first aspect, the invention relates to an umbrellalike clothes drier having a central tubular post and a folding frame, which is preferably adjustably mounted on said post and carries a clothesline and is adapted to be unfolded and collapsed, and in connection with said aspect the object set forth hereinbefore is accomplished in that a vertical storage container is provided, which is disposed beside the tubular post and preferably secured thereto and contains a sacklike flexible sheath, which is adapted to be pulled out of and to be pulled back into said container and to be slipped downwardly over the folding frame when it has been collapsed, and a tensile element is secured at least to that end of the sheath which is at its top when the sleeve has been slipped over the folding frame.

In a second aspect of the invention the object set forth hereinbefore is accomplished in connection with such umbrellalike clothes drier in that the tubular post is open-topped and contains a sacklike flexible sheath, which is adapted to be pulled out of and to be pulled back into said post and is adapted to be slipped downwardly over the folding frame when it has been collapsed, and a tensile element is secured to that end of the sheath which is at its top when the sheath has been slipped over the folding frame.

In a third aspect of the invention the object set forth hereinbefore is accomplished in connection with an umbrellalike clothes drier in that an open-topped storage container is provided, which concentrically surrounds the tubular post and is disposed below the folding frame even when the latter is collapsed, a flexible tubular sheath is contained in said container and is adapted to be pulled out of and pulled back into said container and to be slipped upwardly over the folding frame when it has been collapsed, and a tensile element is secured at least to the top end of the sheath.

In a fourth aspect, the invention relates to a garden umbrella having a central tube, a folding frame, which is adapted to be unfolded and collapsed, and a covering carried by said folding frame and in connection with such garden umbrella the object set forth is accomplished in that the tube is open-topped and contains a sacklike flexible sheath, which is adapted to be pulled out of and to be pulled back into the tube and is adapted to be slipped downwardly over the folding frame and the covering when the folding frame has been collapsed, and a tensile element is secured to that end of the sheath which is disposed at its top when the sheath has been slipped over the folding frame.

In a fifth aspect the invention provides a garden umbrella which comprises a storage container, which concentrically surrounds the central tube and is disposed below the folding frame even when it is collapsed, and said container contains a flexible tubular sheath, which is adapted to be pulled out of and to be pulled back into said container and adapted to be slipped upwardly over said folding frame and the covering, and a tensile element is secured at least to the top end of the sheath.

The sacklike or tubular flexible sheath which is provided in accordance with the invention can be removed in a simple manner from the storage container or the tubular post or the central tube and can be slipped over the folding frame and the clothesline or covering when the folding frame has been collapsed, and by means of the tensile element the sheath can be pulled back into the storage container or tubular post or central tube. All said operations can be performed by a single person.

The slipping of the flexible sheath over the folding frame can be facilitated in that the open-topped storage container communicates with an upwardly convex, annular guiding hood, which overlies the folding frame when it has been collapsed. Alternatively, an upwardly convex, annular guiding hood may be provided at the top end of the tubular post or central tube and may overlie the folding frame when it has been collapsed.

In accordance with the invention the tensile element may consist of a rope which extends in and laterally out of the storage container or tubular post or central tube. In that case the sheath can be pulled back into the storage container or tubular post or central tube simply by a pull on the lower end of the rope which extends out of the storage container, tubular post or central tube at its lower end and a handle may be provided at said lower end of the rope.

In another embodiment of the invention the tensile element may consist of a spring or rubber cord or the like, which is secured in the storage container or tubular post or central tube and is connected, possibly by a rope, to that end of the sheath which is at the top of the sheath when it has been slipped over the folding frame. In that embodiment the sheath which has been slipped over the collapsed folding frame and the clothesline or covering and has been fixed in position can be released so that the spring or rubber cord can automatically pull the sheath back into the storage container, tubular post or central tube.

The handling of the sheath can be facilitated if pulling straps are secured to that end of the sleeve which is at the lower end of the sleeve when it has been slipped over the folding frame. Such straps will permit the sheath to be pulled more easily over the folding frame and can also be used to hold the sheath in its extended position, e.g., in that the straps are perforate and interlocked with the lower ends of the spider arms of the folding frame when it is collapsed or with projections provided on a tubular slider, which surrounds the tubular post or central tube and is slidable along the same to unfold and collapse the folding frame.

In accordance with a further feature of the invention the straps are provided with radially inwardly directed projections, which will engage the outer rim of the guiding hood when the sheath has been retracted. That feature will prevent an excessive retraction of the sheath into the storage container, tubular post or central tube.

Also within the scope of the invention, the tensile element contained in a storage container which surrounds the tubular post of the clothes drier or the central tube of the garden umbrella may consist of springs, rubber cords or the like, which are secured to that end of the sheath which is at the top of the sheath when it has been slipped over the folding frame.

DETAILED DESCRIPTION OF THE PREFERRED EMBODIMENTS

Figure 1:
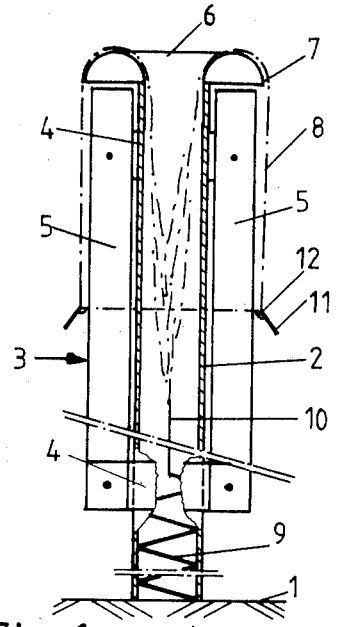
FIG. 1 is a side elevation showing a first embodiment of a collapsed clothes drier provided with a sheath which has partly been slipped over the clothes drier.

Illustrative embodiments of the invention will now be explained more in detail with reference to the drawing.

In FIG. 1 the clothes drier is shown with the folding frame collapsed and provided with a flexible tubular sheath, which can be retracted into the vertical tubular post 2. The tubular post 2 is supported on the ground 1 and carries a folding frame 3, which is adapted to be unfolded and collapsed and consists of hingedly interconnected spreaders and struts, which are hinged to tubular sliders 4, which surround the tubular post 2 and can be fixed to the latter. The spreaders 5 of the folding frame 3 carry a clothesline, not shown, and are hinged to the lower slider 4. The struts are covered by the spreaders 5 when the folding frame 3 has been collapsed; said struts are hinged to the upper slider 4. The tubular post 2 is open-topped and at its top end merges into an upwardly convex, annular guiding hood 6, which has a downwardly facing outer rim 7, which is disposed radially outwardly of the folding frame 3 when it has been collapsed. A sheath 8, which is sacklike, i.e. open at one end and closed at the other, and a tensile element secured to said sheath are disposed in the tubular post 2. The tensile element consists of a tension spring 9 and a rope 10, which is secured to the tension spring and to the closed end of the sheath 8. Alternatively, the tensile element may consist of a rubber cord, which is directly secured at opposite ends to the closed end of the sheath and to the tubular post. In a further alternative a rope may be provided which is secured to the closed end of the sheath and extends from said closed end in a downward direction in the tubular post and extends laterally out of the lower end of the tubular post. In the position shown in FIG. 1 the sheath 8 extends upwardly in the tubular post 2 from that end which is disposed in the tubular post 2 and secured to the tensile element and the sheath is then spread over the upwardly convex, annular guiding hood 6 so that the sheath is reversed and subsequently extends downwardly around the collapsed folding frame 3. Straps 11 are attached to the sheath 8 at that end thereof which is disposed on the outside in FIG. 1 and is at the bottom of the sheath 8 when it has been slipped over the folding frame 3 as far as possible. Said straps can be used to anchor the sheath at the lower ends of the spreaders 5 in that the latter are inserted into holes of the straps. The straps are provided with radially inwardly directed projections 12, which will engage with the outer rim 7 of the guiding hood 6 as the sheath 8 is pulled into the tubular post 2 so that the outer end of the sheath will be arrested at the guiding hood 6.

Figure 2:
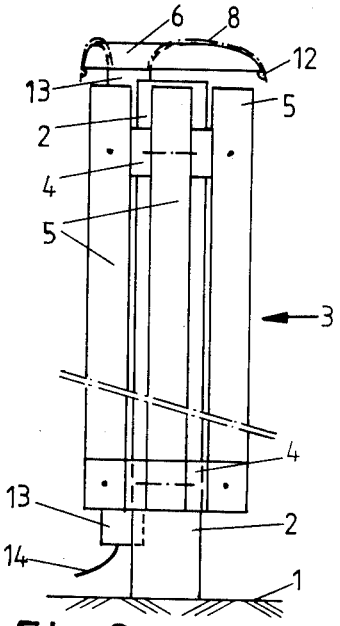
FIG. 2 is a side elevation showing a second embodiment of a collapsed clothes drier.

The clothes drier shown in FIG. 2 is provided with a vertical tubular post 2 and with a vertical storage container 13, which is disposed beside the tubular post 2 between the spreaders 5 of the folding frame 3 and serves to accommodate the sacklike sheath 8. The storage container 13 consists of a tube, which is parallel to the tubular post 2 and merges at its top into an upwardly convex, annular guiding hood, which extends radially beyond the folding frame 3 when it has been collapsed.

In the embodiment shown in FIG. 2 a rope 14 is secured to the sheath 8 at that end thereof which is at the top when the sheath has been slipped over the folding frame 3 as far as possible and which is the inner end of the sheath 8 when the latter has been retracted into the storage container 13. The sheath 8 is provided with radially inwardly directed projections 12 at that end which is the lower end of the sheath 8 when it has been slipped over the folding frame 3 as far as possible and which is the outer end of the sheath 8 when it has been retracted into the storage container 13. The projections 12 engage the outer rim of the guiding hood 6 when the sheath has been retracted.

Figure 3:
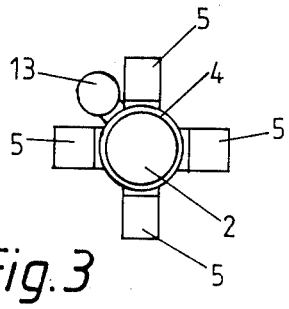
FIG. 3 is a top plan view showing the clothes drier of FIG. 2 after the guiding hood has been removed.

In the embodiment shown in FIGS. 2 and 3 the rope 14 extending out of the storage container 13 may also be replaced by a tension spring or the like, which is accommodated in the storage container and is stressed as the sheath is slipped over the folding frame so that the spring will automatically retract the sleeve into the storage container when the sheath has been released.

Figure 4:
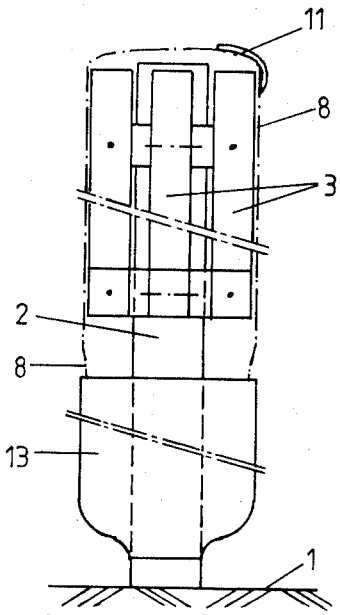
FIG. 4 is a side elevation showing a third embodiment of a collapsed clothes drier.

The clothes drier shown in FIG. 4 comprises a folding frame 3, which is shown in a collapsed condition, and a storage container 13, which is disposed at the bottom end of the tubular post 2 and concentrically surrounds the latter. The storage container 13 serves to store a sheath 8, which is tubular, i.e., open at both ends, and the lower end of which is secured in the storage container. When the sheath 8 is not used, it is contained in a gathered condition in the storage container 13. Tensile elements, such as ropes, are secured to the upper end of the sheath 8 and extend downwardly along the sheath 8 in the storage container. When it is desired to slip the protective sleeve 8 over the collapsed folding frame 3, the top rim of the sheath 8 is pulled upwardly and is slipped over the folding frame 3 and is anchored at the top, e.g., by means of a perforate strap 11 which protrudes from the top edge of the sheath. When it is desired to strip off the sheath, a pull is exerted on the tensile elements, which extend out of the lower portion of the storage container, and the sheath is thus pulled back into the storage container and is gathered therein. The ropes may be replaced by rubber cords or springs, which are anchored in the storage container.

Figure 5:
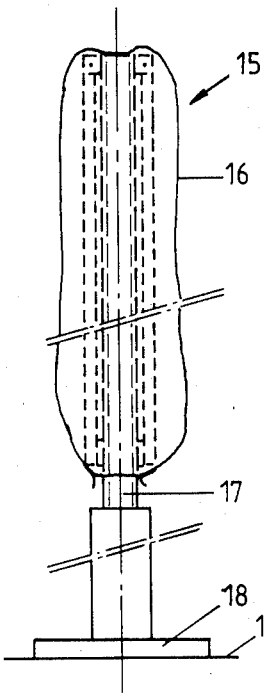
FIGS. 5 and 6 are side elevations showing respective embodiments provided with a sheath which has been slipped over the umbrella.
Figure 6:
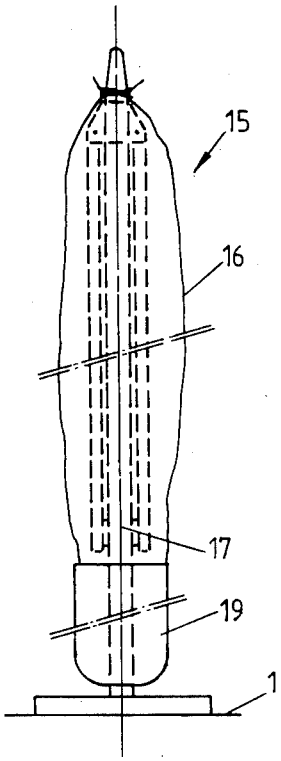

Each of FIGS. 5 and 6 shows a collapsed garden umbrella 15, which is covered by a sheath 16.

In the embodiment shown in FIG. 5 the garden umbrella 15 comprises a central tube 17, which is open-topped and has been inserted into a stand 18. The sheath 16 is sacklike and similar to the sheath of the clothes drier of FIG. 1 and can be retracted into the central tube by means of a rope or a rubber cord or a spring.

In the embodiment shown in FIG. 6, the sheath 16 is tubular and has been pulled out of a storage container 19, which concentrically surrounds the central tube 17, and has been slipped over the collapsed folding frame from below. The tubular sheath 16 is designed like the sheath of the clothes drier shown in FIG. 4.

It will be understood that the central tube of the garden umbrella of FIG. 5 may also be provided at its upper end with an upwardly convex, annular guiding hood.

I claim:

1. In a collapsible structure comprising a rising central tube, a spiderlike folding frame, which is carried by said tube and is adapted to be moved relative to said tube radially outwardly and upwardly to an unfolded position and radially inwardly and downwardly to a collapsed position, in which said folding frame surrounds said tube, and flexible means carried by said folding frame, the improvement residing in that an open-topped tubular structure is provided, which is parallel to said central tube, a flexible sheath is provided, which is longitudinally movable between a retracted position, in which a major portion of said sheath is contained in said tubular structure, and an extended position, in which said sheath surrounds said folding frame when the latter is in said collapsed position, said sheath having first and second ends, which are at the top and bottom, respectively, of said sheath when the latter is in said extended position, and tensile means are secured to said one end of said sheath and adapted to pull said sheath from said extended position to said retracted position.

2. The improvement set forth in claim 1, wherein an upwardly convex, annular guiding hood is provided, which merges into said tubular structure at the top thereof and is arranged to overlie said folding frame when it is in said collapsed position.

3. The improvement set forth in claim 1, wherein said tensile means comprise at least one rope, which extends in said tubular structure and out of the latter at the lower end thereof.

4. The improvement set forth in claim 1, wherein said tensile means comprise at least one resiliently extensible element, which has a first end connected to said first end of said sheath and a second end secured to said tubular structure on the inside thereof and is arranged to be stressed in tension as said sheath is moved from said retracted position to said extended position, and detent means are provided for releasably holding said sheath in said extended position against the tensile force exerted by said resiliently extensible element.

5. The improvement set forth in claim 4, wherein said resiliently extensible element comprises a tension spring.

6. The improvement set forth in claim 4, wherein said resiliently extensible element comprises a rubber cord.

7. The improvement set forth in claim 4, wherein said tensile means comprise at least one rope connecting said first end of said at least one resiliently extensible element to said one end of said sheath.

8. The improvement set forth in claim 4, wherein said detent means comprise peripherally spaced apart, perforate straps attached to said sheath at said second end thereof and means for interlocking with said straps when said sheath is in said extended position.

9. The improvement set forth in claim 1, wherein a plurality of peripherally spaced apart straps are attached to said sheath at said second end thereof.

10. The improvement set forth in claim 9, wherein an upwardly convex, annular guiding hood having a downwardly facing outer rim is provided, which merges into said tubular structure at the top thereof and is arranged to overlie said folding frame when it is in said collapsed position, and each of said straps is provided with a radially inwardly directed projection for engaging said rim when said sheath is in said retracted position.

11. The improvement set forth in claim 1, wherein said tensile means comprise a plurality of ropes, which are connected to said first end of said sheath at peripherally spaced apart points thereof and extend in said tubular structure and out of the latter at the lower end thereof.

12. The improvement set forth in claim 1, wherein said tubular structure consists of an open-topped storage container, which extends beside said central tube, and said sheath is closed at said first end and open at said second end and is adapted to be moved to said extended position in that the sheath is slipped downwardly over said folding frame when it is in said collapsed position.

13. The improvement set forth in claim 11, wherein said storage container is secured to said central tube.

14. The improvement set forth in claim 1, wherein said tubular structure consists of said central tube, which is open-topped, and said sheath is closed at said first end and open at said second end and is adapted to be moved to said extended position in that the sheath is slipped downwardly over said folding frame when it is in said collapsed position.

15. The improvement set forth in claim 1, wherein said tubular structure consists of a tubular storage container, which concentrically surrounds said central tube and has an open top end disposed below said folding frame when it is in said collapsed position, and said sheath is open at both ends and adapted to be moved to said extended position in that it is pulled out of said container at said top end thereof and slipped upwardly over said folding frame when it is in said collapsed position.

16. The improvement set forth in claim 1 as applied to a collapsible structure which constitutes a clothes drier and in which said flexible means consist of at least one clothesline.

17. The improvement set forth in claim 15 as applied to a clothes drier in which said folding frame is axially adjustably mounted on said central tube.

18. The improvement set forth in claim 1 as applied to a collapsible structure which constitutes a garden umbrella and in which said flexible means consist of a covering.

* * * * *